US006607147B2

(12) United States Patent
Schneider et al.

(10) Patent No.: US 6,607,147 B2
(45) Date of Patent: Aug. 19, 2003

(54) HIGH VOLUME SPRINKLER AUTOMATED ARC CHANGER

(75) Inventors: Greg Schneider, Port Orchard, WA (US); Chad Leinweber, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 0 days.

(21) Appl. No.: 10/113,943

(22) Filed: Apr. 2, 2002

(65) Prior Publication Data

US 2002/0158145 A1 Oct. 31, 2002

Related U.S. Application Data

(60) Provisional application No. 60/280,742, filed on Apr. 3, 2001.

(51) Int. Cl.[7] ..... B05B 3/02; B05B 3/14; B05B 3/08; B05B 3/04; B05B 3/16

(52) U.S. Cl. ..... 239/231; 239/230; 239/232; 239/233; 239/236; 239/237; 239/263

(58) Field of Search ..... 239/230, 231, 239/232, 233, 236, 237, 263

(56) References Cited

U.S. PATENT DOCUMENTS

| | | | | |
|---|---|---|---|---|
| 3,559,887 A | | 2/1971 | Meyer | |
| 3,669,353 A | * | 6/1972 | Hanson et al. | 239/177 |
| 3,744,720 A | | 7/1973 | Meyer | |
| 3,788,551 A | * | 1/1974 | Standal | 239/242 |
| 4,094,467 A | * | 6/1978 | Meyer | 239/230 |
| 4,153,202 A | | 5/1979 | Meyer | |
| 4,193,548 A | | 3/1980 | Meyer | |
| 4,235,379 A | * | 11/1980 | Beamer | 239/230 |
| 4,342,424 A | | 8/1982 | Meyer et al. | |
| 4,720,045 A | | 1/1988 | Meyer | |
| 6,364,217 B1 | * | 4/2002 | Lockwood | 239/242 |

* cited by examiner

*Primary Examiner*—Kevin Shaver
*Assistant Examiner*—Anuradha Ramana
(74) *Attorney, Agent, or Firm*—Nixon & Vanderhye P.C.

(57) ABSTRACT

An actuator assembly for a rotatable sprinkler head includes a base supported for rotation on a stationary platform assembly, a hub mounted for rotation on a shaft supported in the base; a lever arm pivotally mounted at one end to the hub and extending downwardly toward a stop plate assembly on the platform assembly, the lever arm having a free end extending toward the stop plate assembly. The stop plate assembly is configured to define two or more distinct arcuate paths of travel for the lever arm, and the lever arm is adjustable to locate the free end in any of the three arcuate paths of travel.

19 Claims, 10 Drawing Sheets

HIGH VOLUME SPRINKLER AUTOMATED ARC CHANGER

This application claims the benefit of provisional application Serial No. 60/280,742 filed Apr. 3, 2001, the entire content of which is hereby incorporated by reference in this application.

BACKGROUND OF THE INVENTION

This invention relates to agricultural irrigation sprinklers and more specifically to large volume sprinkler heads of the rotary step-by-step type that are capable of being operated in a reversing part circle mode. Sprinkler heads of this type are disclosed in U.S. Pat. Nos. 3,559,887; 3,744,720; 4,153,202; 4,193,548; 4,342,424; and 4,720,045. The invention described herein is applicable to sprinkler heads where the part circle mode of operation includes a cycle having an operative or forward step-by-step rotary movement through a part circle arc of travel and a similar speed step-by-step reverse movement through the same arc of travel.

Large volume, part circle sprinklers are often used on traveling irrigation systems (travelers), or as the last (i.e., radially outermost) sprinkler (also known as an end gun) on pivot irrigation systems. In either case, there is a need to change the arc of travel at various points during a typical operation. For example, when a large volume sprinkler is used on a traveler, there is typically a sprinkler cart on which the sprinkler is mounted, with a large hose that feeds the sprinkler strung out through the field in the direction of travel that the sprinkler will irrigate, to another cart supporting a hose reel. In operation, the hose reel rotates, pulling the hose in, along with the sprinkler cart. For a typical rectangular field, the farmer would like to start the sprinkler running against the far end or starting point of the field with the sprinkler irrigating a half circle pattern, looking towards the hose reel. After the sprinkler cart is beyond one radius of throw of the far end of the field, the farmer would then like to irrigate an arc of approximately 270° with the un-irrigated piece being directly between the sprinkler cart and the hose reel. This is usually the best traveling distribution curve for the sprinkler cart since the path where the sprinkler cart travels remains as dry as possible, and thus helps prevent the sprinkler cart from becoming stuck. As the sprinkler cart approaches the hose reel at the near end of the lot, the farmer would like to again change the sprinkler to a half circle arc such that the sprinkler irrigates into the field and not onto the hose reel, i.e., the half circle arc would extend away from the hose reel and near end of the lot. These arc changes may also involve matters of safety since the ends of the field are often roads or buildings or some other area that it is desired to keep dry.

When the large volume sprinkler is used on the end of pivots, it is often used to increase the acreage of ground covered, particularly in the corners of a rectangular field. By intermittently turning the sprinkler on and off, it can be used to irrigate the corners of a square or rectangular field as the pivot is swung in a circle. This is done by turning the sprinkler on as the pivot enters the corner and turning it off as it leaves. By being able to also vary the arc of travel of the sprinkler as the pivot comes into and out of the corner, and as it travels through the corner, a higher degree of accuracy could be obtained while irrigating more of the ground in the corner area of the field.

BRIEF DESCRIPTION OF THE INVENTION

The present invention incorporates an arc changer mechanism that allows a large volume sprinkler to operate using different preset arcs of travel in a manner that is simple, reliable, and easy to adjust. The arc changer mechanism is also designed so that it can be easily retrofitted to an existing large volume sprinkler in the field. On present large volume, part circle sprinklers, there is a fixed "trip lever" or lever arm that operates between two stops that determines the arc of travel through which the sprinkler will rotate. In the exemplary embodiment of the invention, the lever arm is adjustable, and by selectively positioning the lever arm such that it works on different stops, the arc of travel of the sprinkler can be changed. The arc changer in accordance with the exemplary embodiment utilizes two hydraulic cylinders (an upper cylinder and a lower cylinder) to move the trip lever between three positions of operation.

More specifically, the trip lever is pivotally mounted to a hub, with a pair of links pivotally mounted at one end on the lever, on opposite sides of the trip lever pivot. Each of the pair of links is attached at opposite ends to pistons slidably supported in the hub for axial movement within hydraulic chambers or cylinders. Depending on which of the pistons is actuated, the trip lever is caused to swing inwardly or outwardly on its own pivot. Thus, the remote end of the lever is moved radially outwardly to a first position when hydraulic fluid is supplied to the lower chamber. The lever is moved radially inwardly to a third position when hydraulic fluid is supplied to the upper chamber. When neither chamber is pressurized, the lever is balanced by springs in an intermediate or second position, radially between the first and third positions.

The stops are designed such that their outside radii are shaped like arcuate cams that correspond to the first, second and third positions of the lever arm. In this regard, the remote end of the lever arm is fitted with a cam roller. During normal rotation through an arc of travel, the cam roller moves through its arc without engaging the adjacent cam surface. However, when the arc changer is actuated to move the lever arm to another position when the sprinkler is in a position that is not already in the range of the new stop set, the roller on the end of the trip lever arm will be forced onto the cam surface of the stop. The sprinkler will continue to operate with the trip lever roller, rolling along the cam surface until it falls within the operating zone, i.e., within the circumferential arc, of the new particular set of stops. If the sprinkler is transitioned into the next set of stops when the lever arm is circumferentially within the arc of the next set of stops, it will change arcs without the roller contacting any of the arc shaped cam surfaces.

As described herein, the sprinkler uses hydraulic cylinders or chambers using water as the working fluid. These cylinders could also be pneumatic, oil hydraulic, or electromechanical. The input for changing the arc may be conventional timers, remote control or hardwired signals operating solenoids or other forms of control valves. The adjustable stops may be made by providing the cams on plates arranged to slide under and/or over each other, thus allowing greater range of arc variation. This allows the end user to easily adjust the sprinkler to their specific application.

According to one aspect, the present invention relates to an actuator assembly for a rotatable sprinkler head having a base supported for rotation on a stationary platform assembly, the actuator assembly comprising a hub mounted for rotation on a shaft supported in said base; a lever arm pivotally mounted at one end to said hub and having a free end extending downwardly toward a stop plate assembly supported on said platform assembly; said stop plate assembly configured to define two or more arcuate paths of travel for said lever arm, said paths being radially offset relative to said hub; and wherein said lever arm is adjustable to selectively locate said free end in any of said two or more arcuate paths of travel.

In another aspect, the invention relates to an actuator assembly for a large volume sprinkler head mounted for rotation relative to a stop plate assembly, the actuator assembly comprising a lever arm on the sprinkler head adapted to cooperate with the stop plate assembly to define different paths of travel for the sprinkler head; the lever arm movable radially between the different paths of travel.

The invention will now be described in greater detail in connection with the various drawing figures identified below.

DETAILED DESCRIPTION OF THE INVENTION

Figure 1:
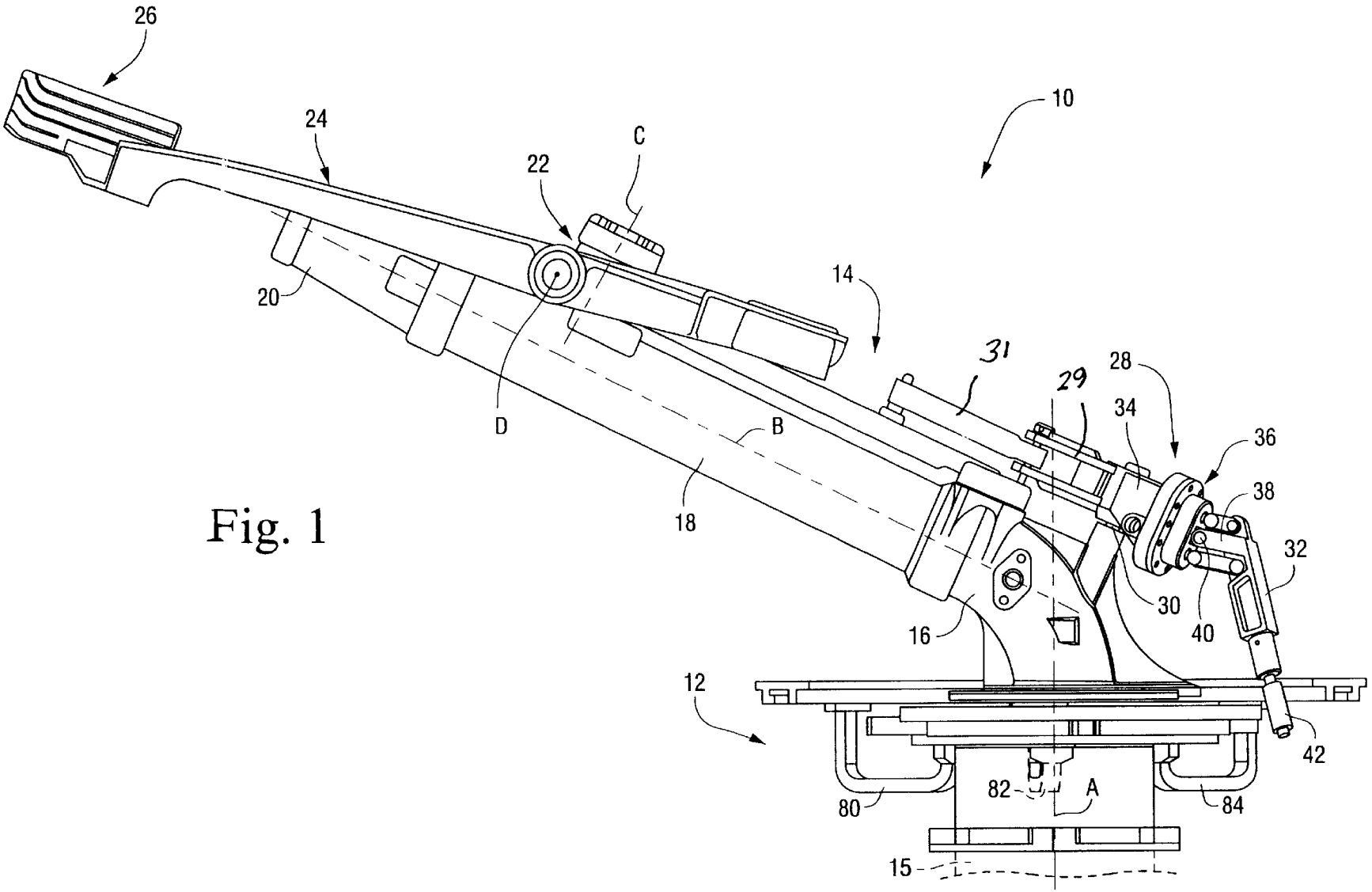
FIG. 1 is a side elevation of a large volume part circle sprinkler head and arc changer mechanism in accordance with an exemplary embodiment of the invention.

With reference to FIG. 1, there is shown a sprinkler head 10 that includes a stationary annular platform assembly 12 adapted to be fixedly mounted at its lower portion on a source pipe or the like (shown in dotted line configuration at 15) for supplying water to the sprinkler head under pressure. Mounted on the platform assembly for rotational movement about a fixed vertical axis A, coincident with the vertical axis of the platform assembly, is a rotating sprinkler body assembly generally indicated at 14. The platform assembly 12 incorporates a brake and bearing arrangement (not shown) that serves to mount the sprinkler body assembly on the annular platform assembly 12 for controlled rotational movement in clockwise or counterclockwise directions. That portion of the platform assembly that receives the sprinkler body assembly 14, as well as the sprinkler body assembly itself, is preferably constructed in accordance with commonly owned U.S. Pat. No. 4,720,045, incorporated herein by reference.

The sprinkler body assembly 14 includes an elbow or base 16 having an elongated barrel 18 fixed thereto. At the outlet end of the barrel 18, there is secured a nozzle 20 serving to direct a stream of water in an upwardly and outwardly direction. Mounted on the barrel 18 for pivotal movement about an axis substantially perpendicular to the longitudinal axis B of the barrel 18 is a yoke 22 that moves between first and second operating positions. The yoke 22 serves to mount an impulse arm assembly 24 for movement with the yoke into two corresponding operating positions and for oscillating movements about a transversely extending oscillatory axis D. Note that axis D is disposed above the longitudinal axis B of the barrel 18 and in a position outwardly of the pivot axis C of the yoke and impulse arm assembly in the downstream direction.

The impulse arm assembly 24 has mounted on its outward end a drive spoon generally indicated at 26. The drive spoon is operable in either of the two operating positions of the yoke or impulse arm assembly and functions to effect continuous oscillatory cycles of the impulse arm assembly 24, during each one of which, the drive spoon 26 is moved into a position of engagement with the stream issuing from the nozzle. The detailed construction and operation of the sprinkler head per se, including the yoke, impulse arm assembly and spoon assembly are well known as described in the above-identified commonly owned patents. The sprinkler head may also be one that is currently available from the assignee, Nelson Irrigation Corp., under the name "SR 150 Big Gun." In addition, the manner in which the sprinkler head rotates in step-wise fashion and reverses direction is also well known as described in the above-identified patents, and need not be described in detail here. This invention relates specifically to an arc changer mechanism for use with the sprinkler head.

The actuator assembly includes a hub 34 mounted for rotation in the elbow 16 via a shaft 30. The actuator assembly also includes a bifurcated lever arm 29 that cooperates with a tube 31 that form part of an overcenter resilient toggle mechanism that facilitates the oscillating motion of the sprinkler. This action is fully described in the '045 patent.

Figure 2:
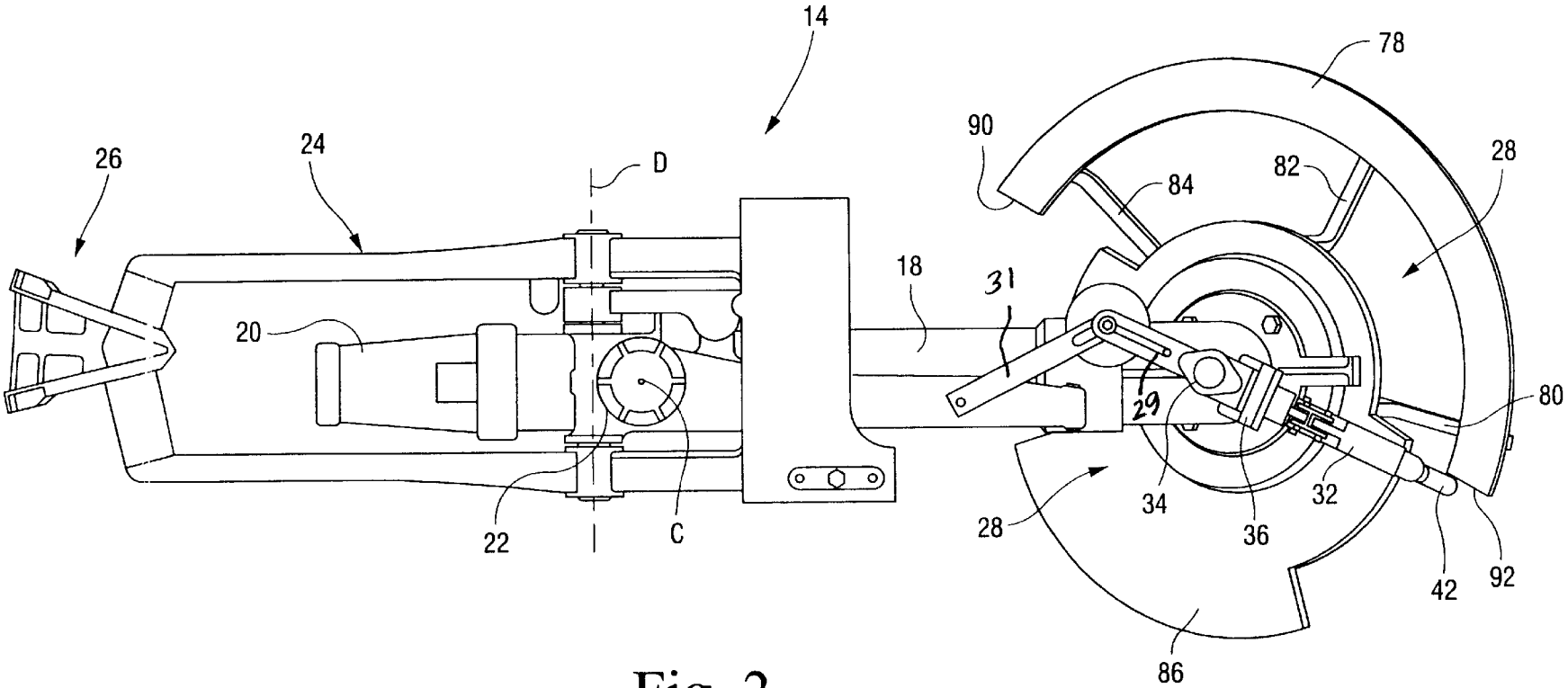
FIG. 2 is a plan view of the sprinkler head shown in FIG. 1, with the barrel of the sprinkler head rotated to a horizontal plane.
Figure 4:
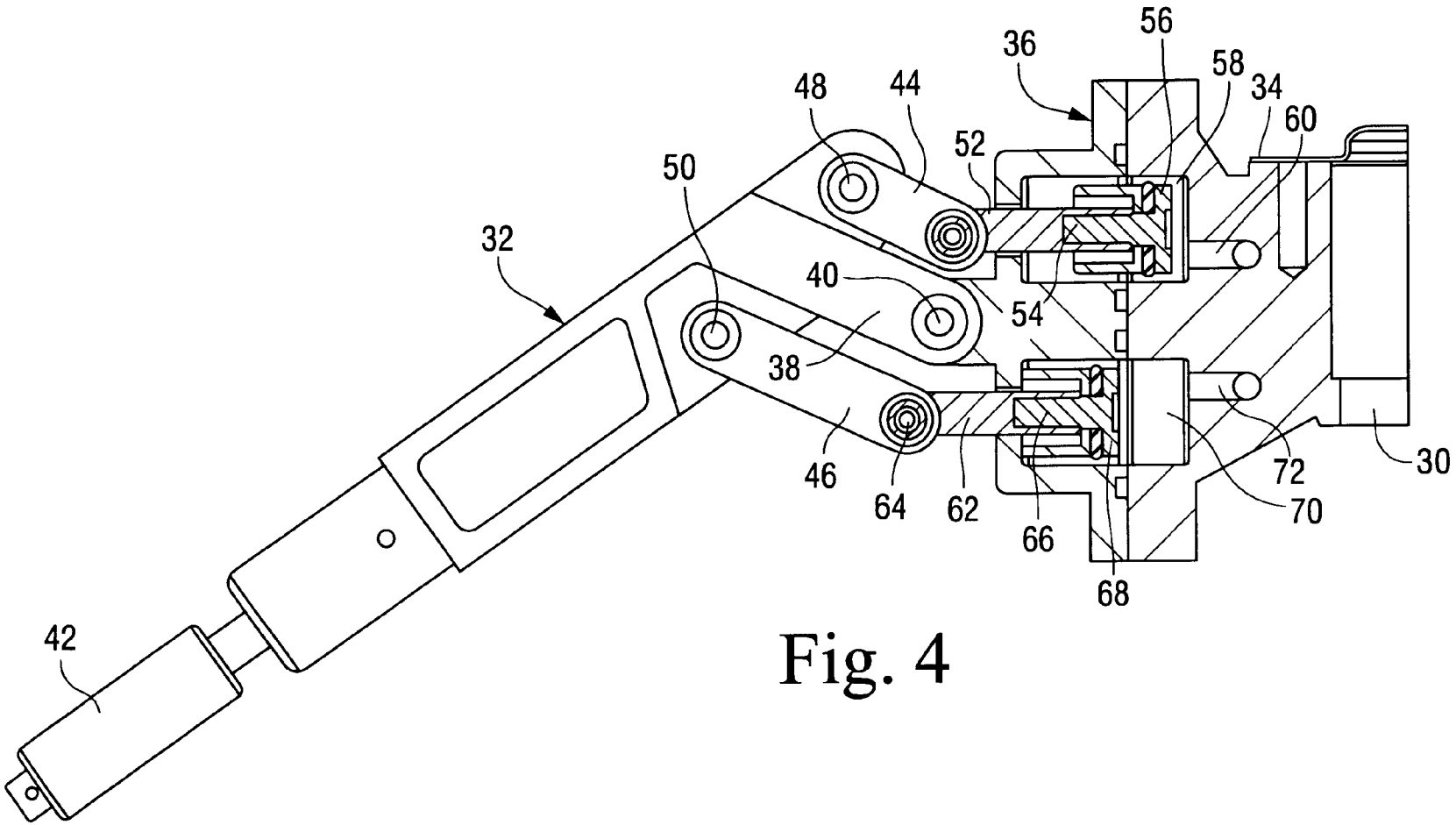
FIG. 4 is a side elevation, partly in section, showing the lever arm in a first outer operative position.

With reference particularly to FIGS. 1, 2 and 4, the lever arm 32 in the exemplary embodiment is pivotally mounted at one end to the housing 36 and hub 34 by means of a fixed link 38 and pivot pin 40. The lever arm 32 is provided at its opposite end with a cam roller 42. Movement about the pivot pin 40 is controlled by a pair of links 44, 46 that are pivotally mounted to the lever arm, on either side of link 38, by respective pivot pins 48 and 50. The upper link 44 is, in turn, pivotally connected to a rod 52 fixed for sliding movement inside the housing 36. Rod 52 is attached to one end of a piston rod 54, an associated piston head 56 slidable within cylinder or chamber 58. Chamber 58 is supplied with working fluid (water, in the exemplary embodiment) via passage 60 in the hub 34.

The lower link 46 is similarly pivotally connected to a second rod 62 via pivot pin 64. Rod 62 is also confined to sliding movement in the housing 36 and is attached to a second piston rod 66. Piston head 68 is slidable within a second cylinder chamber 70 that is supplied with working fluid via passage 72.

The cam roller 42 at the remote end of the lever arm 32 is shown in its upper or radially outermost position in FIG. 4, as a result of water under pressure being supplied to the second chamber 70. This causes piston 66 and rod 62 to push lower link 46 to the left, at the same time pushing the lever arm 32 in a clockwise direction about the pivot pin 40. Note that the absence of water pressure in the first chamber 58 permits the rod 52 and link 44 to move to the right to accommodate the clockwise movement of the lever arm 32.

Figure 5:
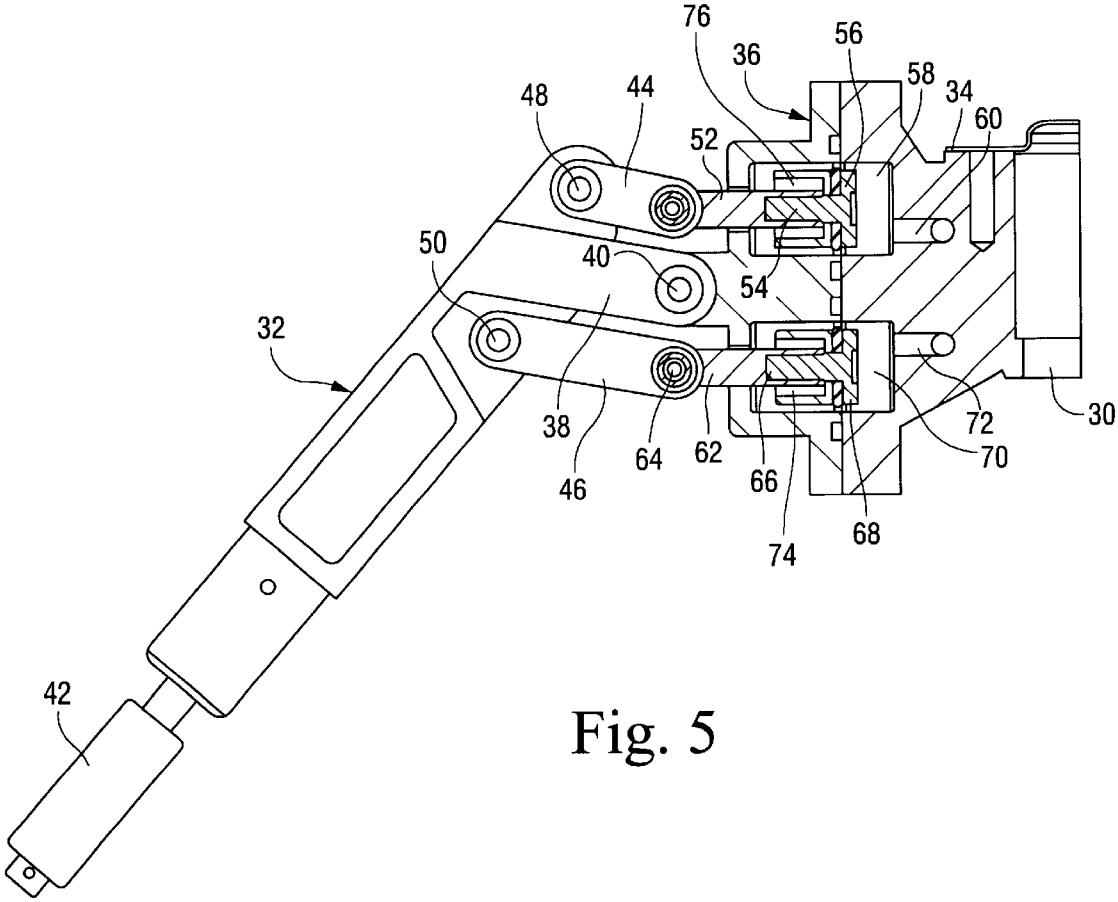
FIG. 5 is a side elevation, partly in section, showing the lever arm in a second intermediate operating position.

FIG. 5 illustrates the lever arm 32 in an intermediate position, as a result of balanced return springs 74, 76, acting on the respective pistons with no water pressure in either of chambers 58 or 70.

Figure 6:
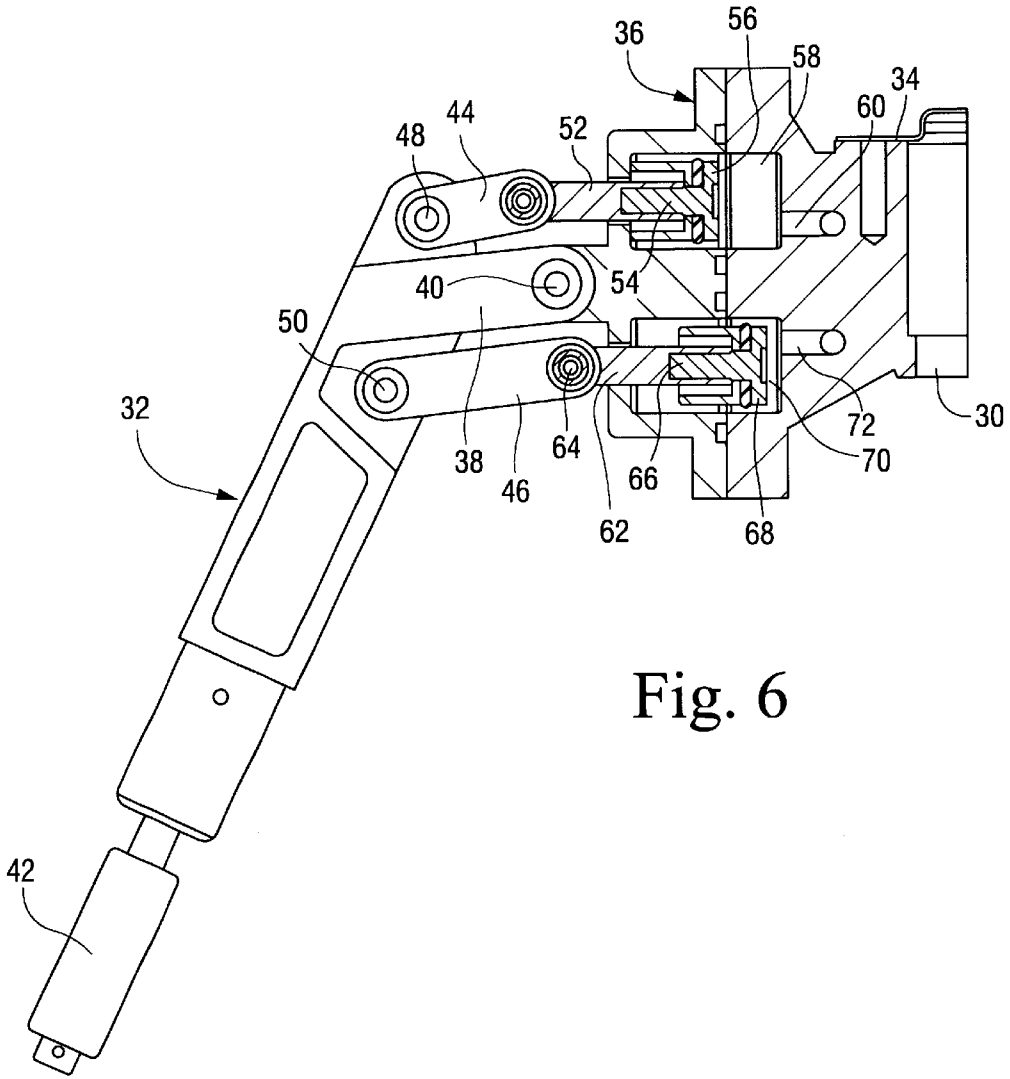
FIG. 6 is a side elevation, partly in section, showing the lever arm in a third inner operating position.

FIG. 6 illustrates the lever arm 32 in a radially inner and lower position, caused by the supply of water under pressure to the first chamber 58. This pushes piston 54, rod 52 and link 44 to the left, resulting in counterclockwise rotation of the lever arm 32 about the pivot pin 40. The lack of any water pressure in the second chamber 70 permits the link 46 to push the rod 62 and piston 66 to the right as viewed in the Figure.

Figure 3:
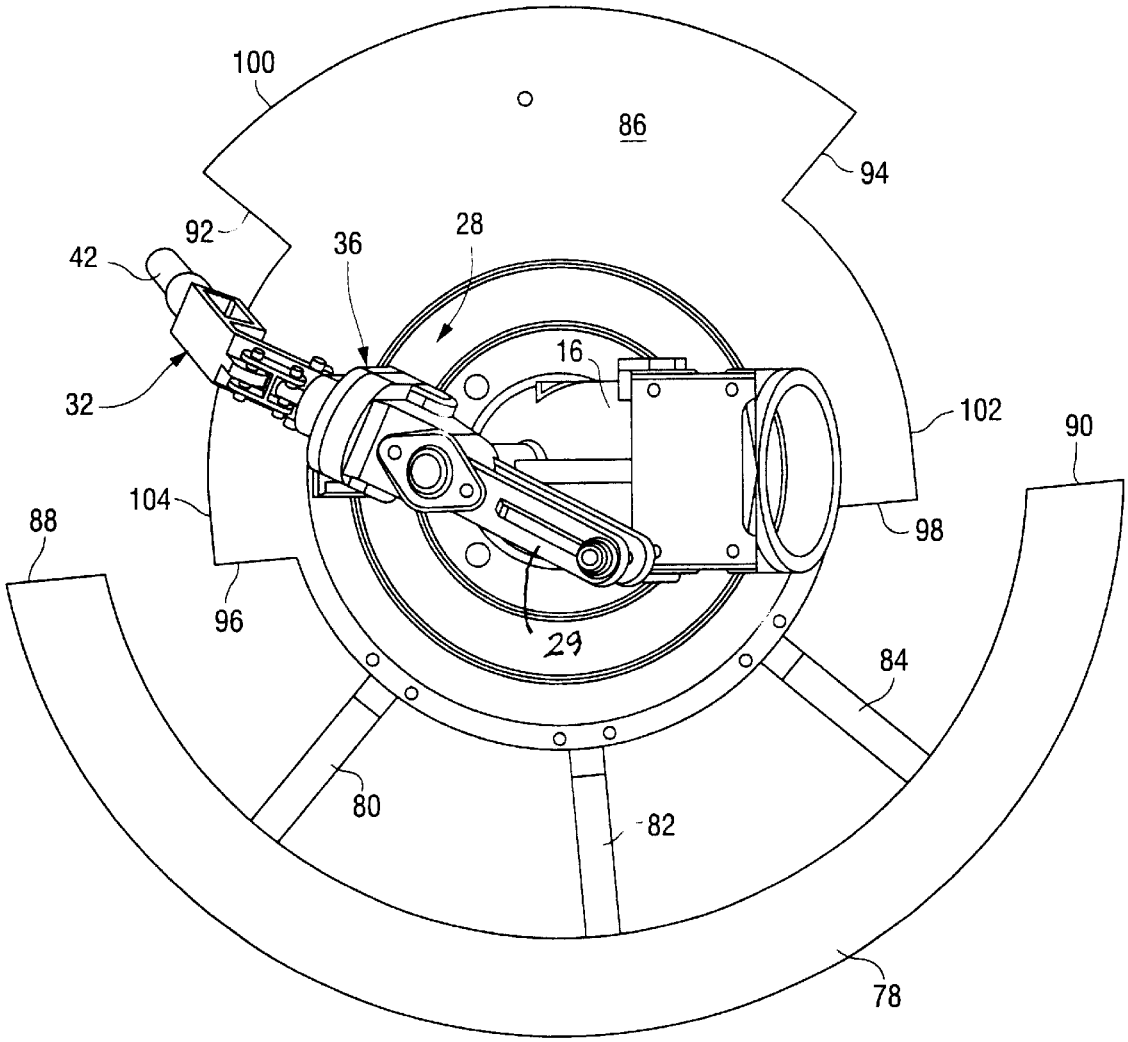
FIG. 3 is a plan view of the arc changer mechanism, with the sprinkler barrel removed.
Figure 7:
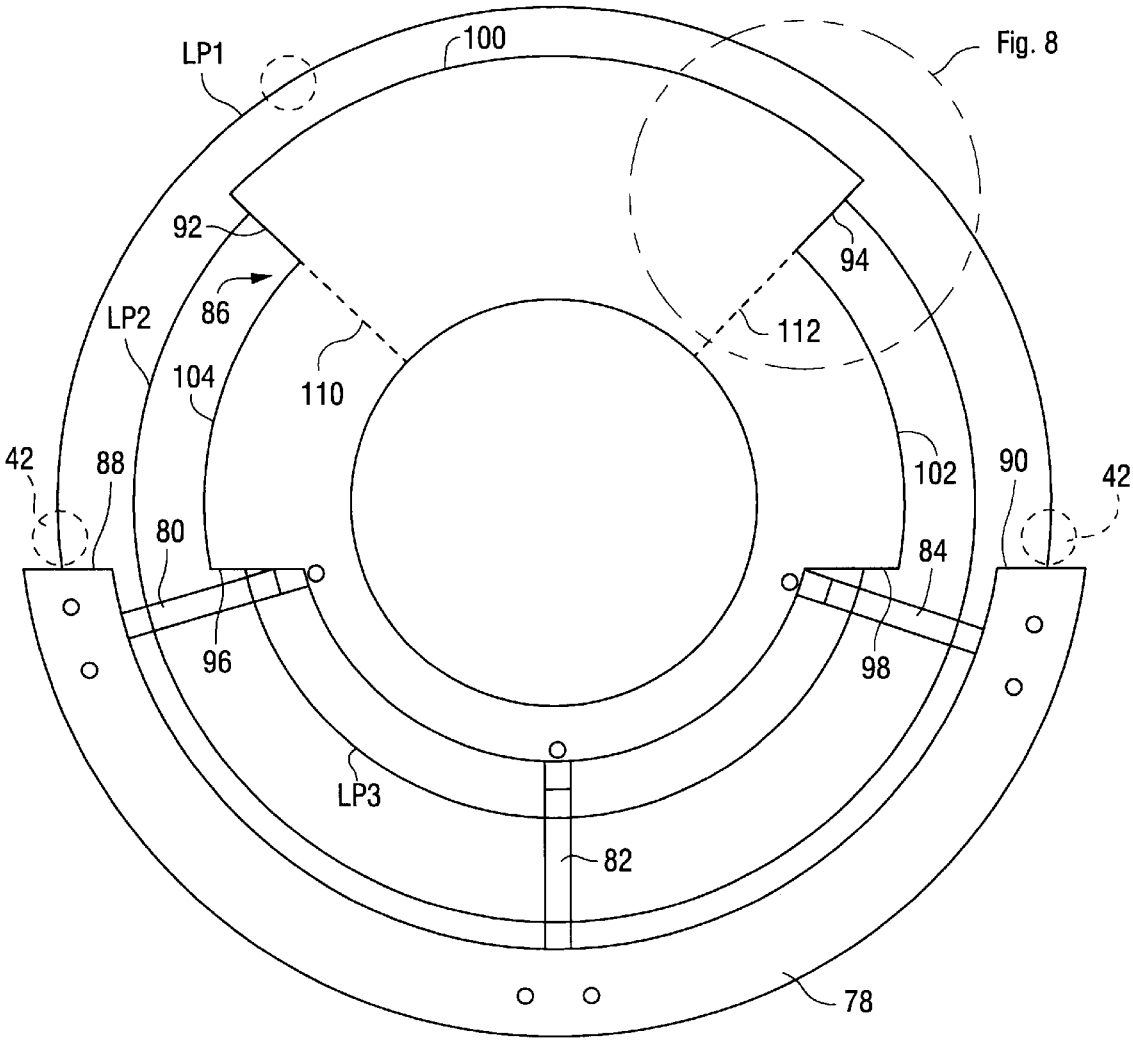
FIG. 7 is a plan view of a stop ring and stop plates taken from FIGS. 1–3.

With reference now to FIGS. 3 and 7, the platform assembly also includes an outer stop ring 78 that is supported by three circumferentially spaced, generally U-shaped struts 80, 82 and 84 that extend substantially radially between the outer stop ring 78 and a stop plate 86 concentrically located relative to a pipe inlet flange of elbow 16. Stop plate 86 is located below, but parallel to the outer stop ring 78. End edges 88 and 90 of the outer stop ring 78 define the limits of a first path of approximately 180° for the lever arm 32, the lever path indicated by LP1 in FIG. 7. This path will be followed by the lever arm when it is in its extended position, shown in FIG. 4. This path provides the sprinkling pattern designated SP1 in FIG. 10.

Figure 10:
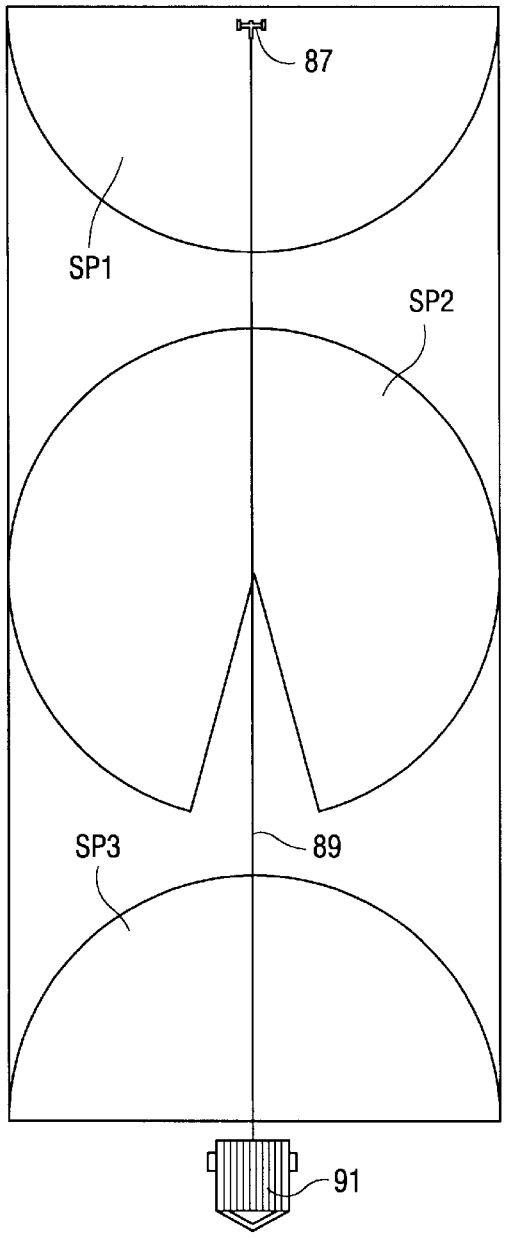
FIG. 10 is a diagram of a field showing different arcs of travel based on the stops arranged as shown in FIG. 7 in the context of a traveler-type sprinkler.

A second path LP2 extends between intermediate end edges 92, 94 of the stop plate 86 and corresponds to the sprinkling pattern SP2 in FIG. 10.

A third path LP3 extends between inner end edges 96, 98 of the stop plate 86 and corresponds to the sprinkling pattern SP3 in FIG. 10.

During a normal sequence of reversing action with the lever arm 32 in the extended position (FIG. 4) in path LP1, the cam roller will not engage the camming surface 92 on the stop plate 86, but will remain radially spaced therefrom as indicated in phantom in FIG. 7, to produce the pattern SP1 in FIG. 10 Note in FIG. 10 that the sprinkler cart is shown at 87, the hose at 89 and the hose reel at 91.

When the arc changing mechanism actuator is actuated to move the lever arm 32 to its intermediate position shown in FIG. 5, so as to begin following path LP2, the cam roller 32 may be within the arcuate range of LP2 or outside the range of LP2. Note that the part of LP1 that is outside the range of LP2 corresponds to the arcuate extent of camming surface 100 on the plate 86. If the lever arm 32 is within the arcuate extent of camming surface 100 when the arc changer is actuated to move it from LP1 to LP2, the roller will be drawn into engagement with surface 100 (see FIG. 8) as the lever arm 32 pivots inwardly about pivot 40. When the roller reaches edge 94, it will fall into the second path LP2 (but it will not engage the inner camming surface 102). If, on the other hand, the lever arm 32 is within the range of LP2, i.e., beyond camming surface 100, it will simply fall into LP2. Note this description assumes clockwise movement of the lever arm 32. The same action will occur in the opposite direction as well.

As the lever arm oscillates between stops or edges 92, 94 in LP2, creating the pattern SP2 in FIG. 10, the roller 42 will not engage camming surface 102 nor the opposite camming surface 104 at the other end of the arc of travel in LP2.

When the arc changer is actuated to move the lever arm 32 into LP3, the lever arm may again be inside or outside the range of LP3. If outside the range, the roller 42 will be caused to engage camming surface 102 (or 104) until it reaches edge 98 (or 96) where it will fall into the path LP3 in the same manner as described above in connection with the transition from LP1 to LP2. In LP3, the lever arm will oscillate between stop edges 96, 98 to create the pattern SP3 in FIG. 10.

Figure 9:
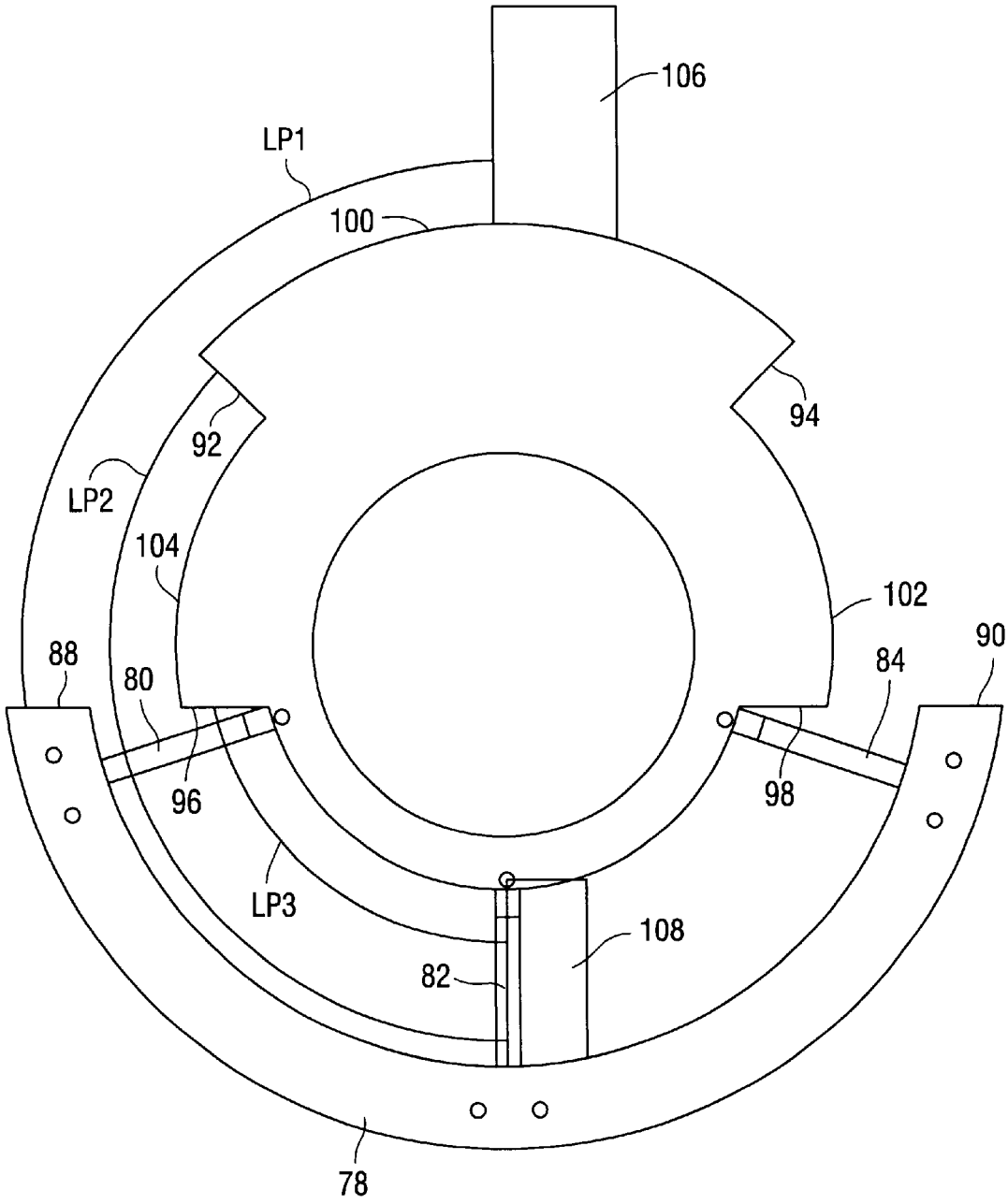
FIG. 9 is a plan view of a modified stop arrangement.
Figure 11:
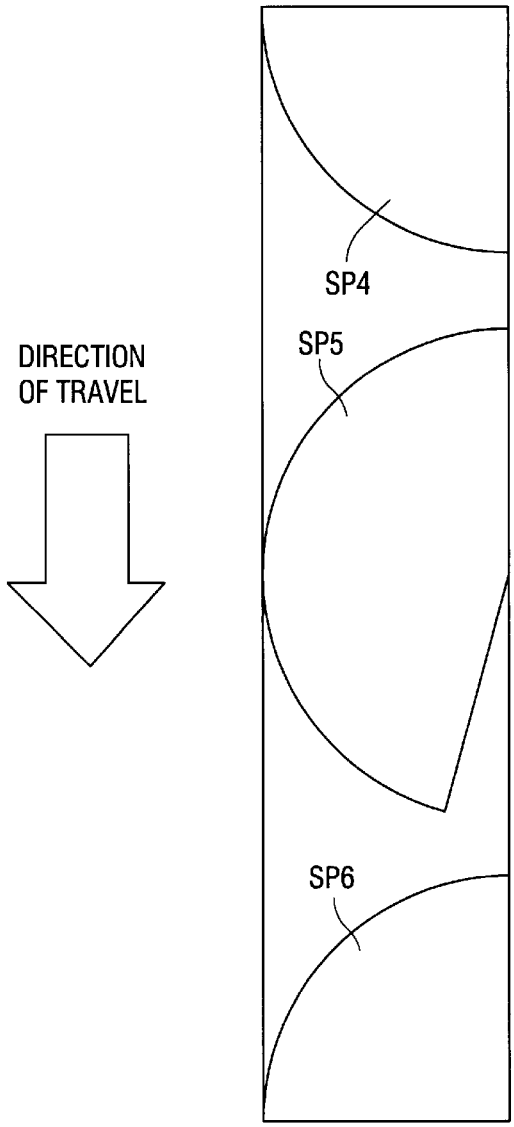
FIG. 11 is a diagram of a field showing different arcs of travel based on the stops arranged as shown in FIG. 9.
Figure 2:
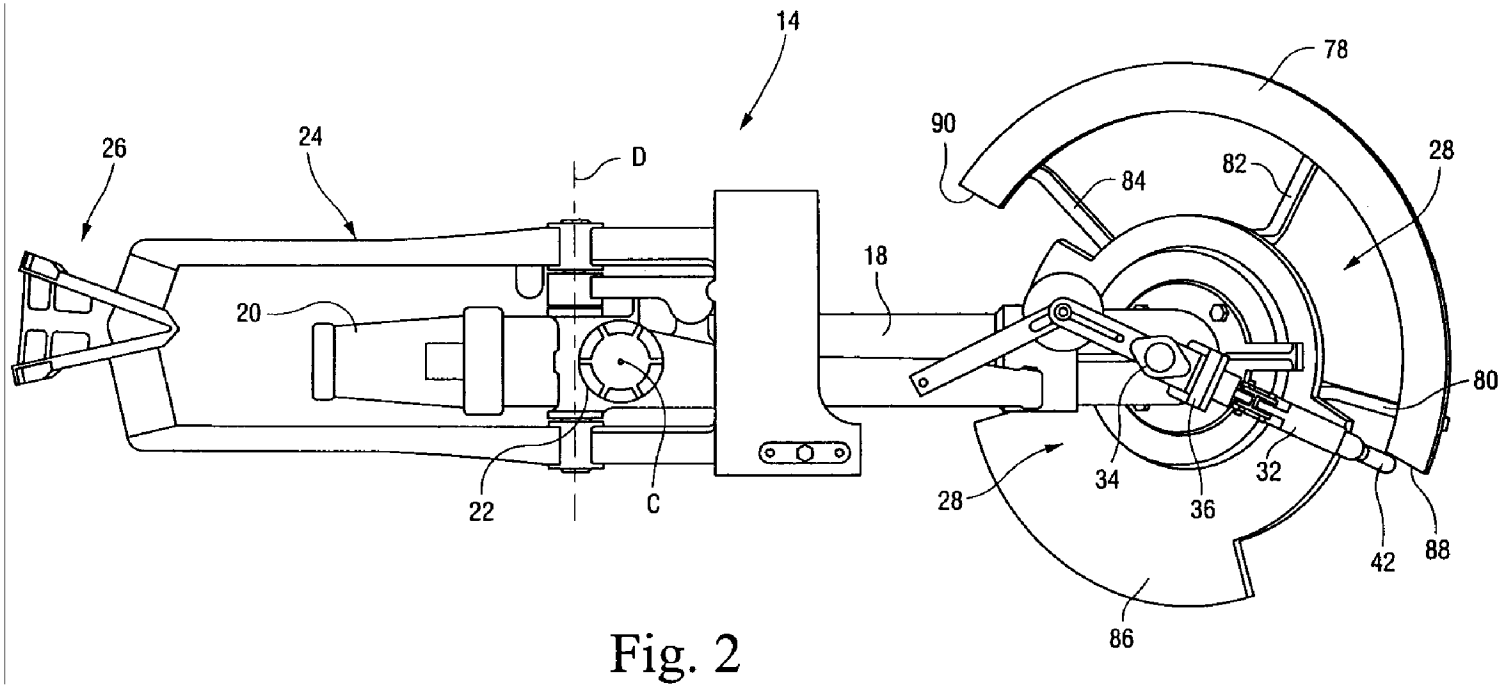
Figure 8:
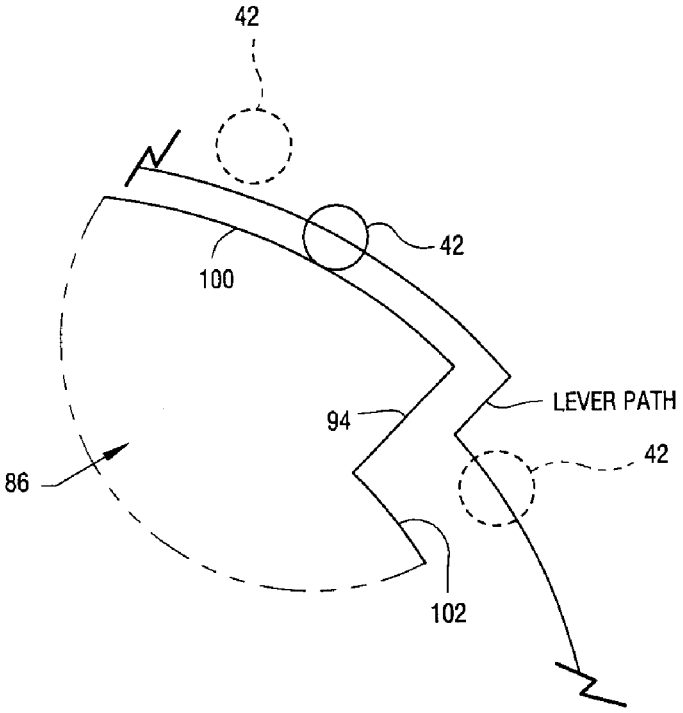
Figure 9:
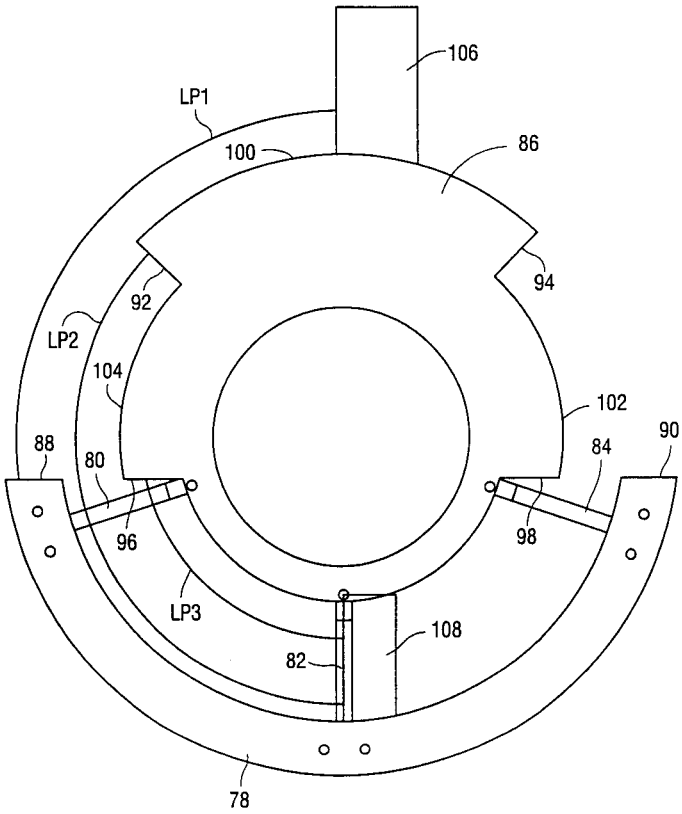

While the outer ring 78 and stop plate 86 have been described as fixed in a rigid configuration, other arrangements are contemplated. The outer ring 78 and stop plate 86 may be made rotationally adjustable, and one or more stops may be added. In FIG. 9, for example, two additional stops 106, 108 have been added. Stop 106 will reduce LP1 to a 90° arc of travel, corresponding to SP4 in FIG. 11. Stop 108 will reduce LP2 to a 135° arc of travel corresponding to SP5 in FIG. 11, and stop 108 will also reduce LP3 to a 90° arc of travel corresponding to SP6 in FIG. 11. This arrangement is particularly useful when irrigating next to a fence, building or the like located along the side of the field or lot.

A similar stop plate assembly with different stop sets can be used when the sprinkler is employed as an end gun in a pivot system. The end gun can be turned on and off, with different arcs of travel, as the pivot boom moves into, through and out of the corner area, causing more of the field to be irrigated.

It will also be appreciated that the stop plate 86 may be constructed in two or more sections (indicated by the dotted lines 110, 112 in FIG. 7), with one plate section sliding above or below the other to provide greater flexibility in setting up different arcuate paths for the sprinkler head.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An actuator assembly for a rotatable sprinkler head having a base supported for rotation on a stationary platform assembly, the actuator assembly comprising a hub mounted for rotation on a shaft supported in said base; a lever arm pivotally mounted at one end to said hub and having a free end extending downwardly toward a stop plate assembly on said platform assembly; said stop plate assembly configured to define two or more arcuate paths of travel for said lever arm, said paths being radially offset relative to said hub; and wherein said lever arm is adjustable to locate said free end in any of said two or more arcuate paths of travel; and wherein said stop plate assembly includes an outer ring having a first pair of end edges defining limits of a first arcuate path traveled by said lever arm, and an inner stop plate, located radially inwardly of said outer ring, having a second pair of end edges defining limits of a second arcuate path traveled by said lever arm.

2. The actuator assembly of claim 1 wherein a third pair of end edges on said stop plate define limits of a third arcuate path traveled by said lever arm.

3. The actuator assembly of claim 2 wherein said lever arm has a first link fixed at one end to said lever arm and pivotally mounted at an opposite end to said hub, and a pair of links, respectively, on either side of said first link, said pair of links each pivotally secured to said lever arm at first ends thereof, and pivotally secured to rods slidably received on said hub at second, opposite ends thereof.

4. The actuator assembly of claim 3 wherein said rods are connected to pistons movable within respective chambers in said hub.

5. The actuator assembly of claim 4 wherein pressurization of one of said chambers with a working fluid causes said free end of said lever arm to move outwardly to said first arcuate path.

6. The actuator assembly of claim 5 wherein pressurization of the other of said chambers with the working fluid causes said free end of said lever arm to move inwardly to said third arcuate path.

7. The actuator assembly of claim 6 wherein springs in said chambers cause said free end of said lever arm to move to said second arcuate path when neither chamber is pressurized.

8. The actuator assembly of claim 5 wherein said working fluid is water.

9. An actuator assembly for a rotatable sprinkler head having a base supported for rotation on a stationary platform assembly, the actuator assembly comprising a hub mounted for rotation on a shaft supported in said base; a lever arm pivotally mounted at one end to said hub and having a free end extending downwardly toward a stop plate assembly on said platform assembly; said stop plate assembly configured to define two or more arcuate paths of travel for said lever arm, said paths being radially offset relative to said hub; and wherein said lever arm is adjustable to locate said free end in any of said two or more arcuate paths of travel; and further wherein said lever arm has a first link fixed at one end to said lever arm and pivotally mounted at an opposite end to said hub, and a pair of links, respectively, on either side of said first link, said pair of links each pivotally secured to said lever arm at first ends thereof, and pivotally secured to rods slidably received on said hub at second, opposite ends thereof.

10. The actuator assembly of claim 9 wherein said rods are connected to pistons movable within respective chambers in said hub.

11. An actuator assembly for a large volume sprinkler head mounted for rotation relative to a stop plate assembly, the actuator assembly comprising a lever arm on said sprinkler head adapted to cooperate with said stop plate assembly to define different paths of travel for said sprinkler head; said lever arm movable radially between said different paths of travel; wherein said stop plate assembly includes an outer ring having a first pair of end edges defining limits of a first arcuate path traveled by said lever arm, and an inner stop plate having a second pair of end edges defining limits of a second arcuate path traveled by said lever arm.

12. The actuator assembly of claim 11 wherein a third pair of end edges on said stop plate define limits of a third arcuate path traveled by said lever arm.

13. The actuator assembly of claim 12 wherein said second arcuate path lies radially inwardly of said first arcuate path; and wherein said third arcuate path lies radially inwardly of said second arcuate path.

14. An actuator assembly for a large volume sprinkler head mounted for rotation relative to a stop plate assembly, the actuator assembly comprising a lever arm on said sprinkler head adapted to cooperate with said stop plate assembly to define different paths of travel for said sprinkler head; said lever arm movable radially between said different paths of travel; wherein said stop plate assembly includes an outer ring having a first pair of end edges defining limits of a first arcuate path traveled by said lever arm, and an inner stop plate having a second pair of end edges defining limits of a second arcuate path traveled by said lever arm; and further wherein said lever arm has a first link fixed at one end to said lever arm and pivotally mounted at an opposite end to said hub, and a pair of links, respectively, on either side of said first link, said pair of links each pivotally secured to said lever arm at first ends thereof, and pivotally secured to rods slidably received on said hub at second, opposite ends thereof.

15. The actuator assembly of claim 14 wherein said rods are connected to pistons movable within respective chambers in said hub.

16. The actuator assembly of claim 15 wherein pressurization of one of said chambers with a working fluid causes said free end of said lever arm to move outwardly to said first arcuate path.

17. The actuator assembly of claim 16 wherein pressurization of the other of said chambers with the working fluid causes said free end of said lever arm to move inwardly to said third arcuate path.

18. The actuator assembly of claim 17 wherein springs in said chambers cause said free end of said lever arm to move to said second arcuate path when neither chamber is pressurized.

19. The actuator assembly of claim 16 wherein said working fluid is water.

* * * * *

UNITED STATES PATENT AND TRADEMARK OFFICE

CERTIFICATE OF CORRECTION

PATENT NO. : 6,607,147 B2
DATED : August 19, 2003
INVENTOR(S) : Schneider et al.

Figure 8:
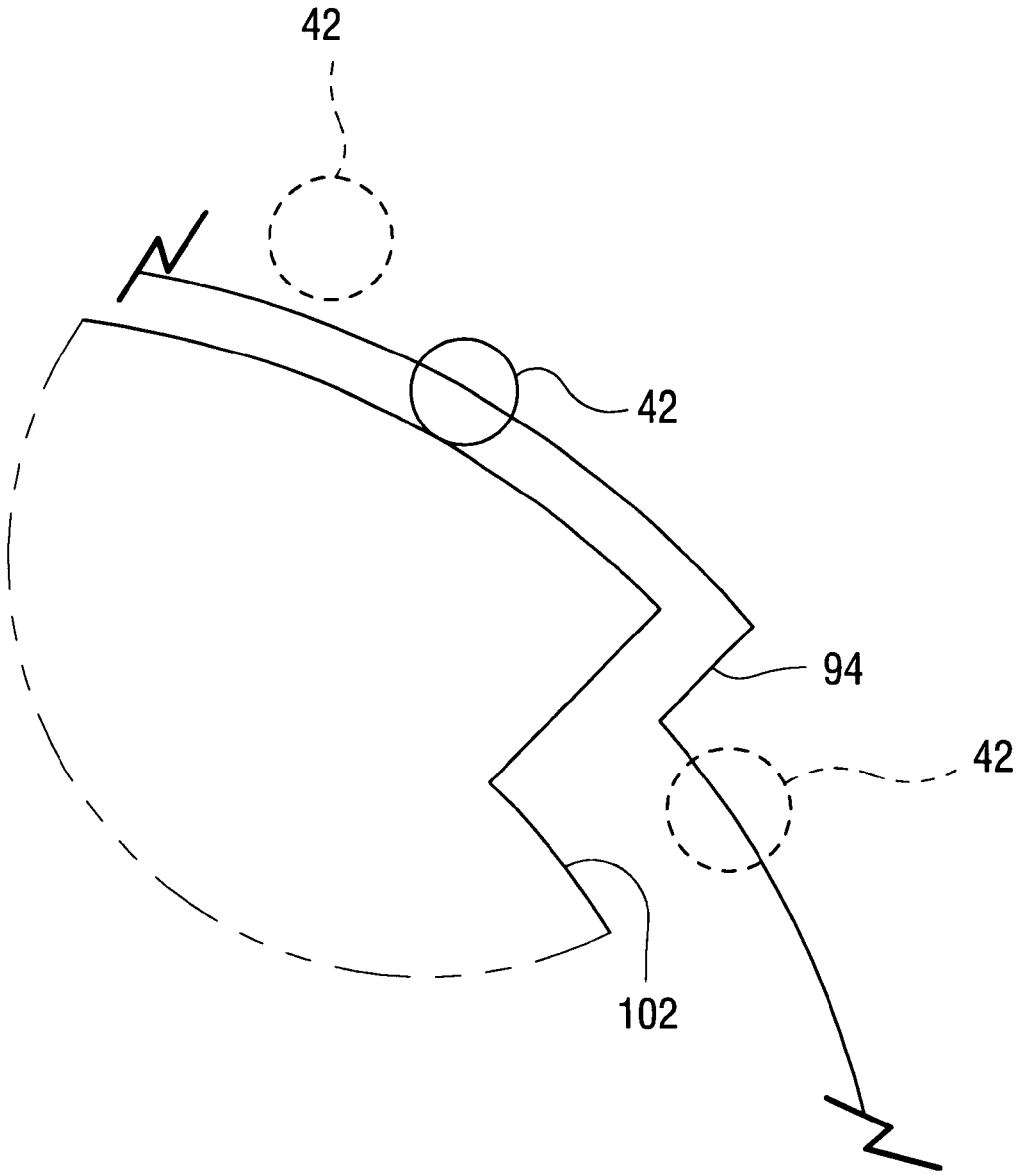
FIG. 8 is a detail taken from FIG. 7.

It is certified that error appears in the above-identified patent and that said Letters Patent is hereby corrected as shown below:

Drawings,
Fig. 2, Fig.8, and Fig. 9, should be deleted and replaced with the drawing sheets, consisting of Fig.2, Fig.8, and Fig. 9, as shown on the attached pages.

Column 2,
Line 47, delete “arc shaped” and insert -- arc-shaped --.

Column 5,
Line 32, delete “92” and insert -- 100 --.
Line 35, delete “Fig. 10Note” and insert -- Fig. 10. Note --.
Line 39, delete “32” and insert -- 42 --.

Signed and Sealed this

Fifteenth Day of March, 2005

JON W. DUDAS
*Director of the United States Patent and Trademark Office*

(12) United States Patent
Schneider et al.

(10) Patent No.: US 6,607,147 B2
(45) Date of Patent: Aug. 19, 2003

(54) HIGH VOLUME SPRINKLER AUTOMATED ARC CHANGER

(75) Inventors: Greg Schneider, Port Orchard, WA (US); Chad Leinweber, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 0 days.

(21) Appl. No.: 10/113,943

(22) Filed: Apr. 2, 2002

(65) Prior Publication Data

US 2002/0158145 A1 Oct. 31, 2002

Related U.S. Application Data

(60) Provisional application No. 60/280,742, filed on Apr. 3, 2001.

(51) Int. Cl.[7] ..... B05B 3/02; B05B 3/14; B05B 3/08; B05B 3/04; B05B 3/16

(52) U.S. Cl. ..... 239/231; 239/230; 239/232; 239/233; 239/236; 239/237; 239/263

(58) Field of Search ..... 239/230, 231, 239/232, 233, 236, 237, 263

(56) References Cited

U.S. PATENT DOCUMENTS

| | | | | | |
|---|---|---|---|---|---|
| 3,559,887 | A | | 2/1971 | Meyer | |
| 3,669,353 | A | * | 6/1972 | Hanson et al. | 239/177 |
| 3,744,720 | A | | 7/1973 | Meyer | |
| 3,788,551 | A | * | 1/1974 | Standal | 239/242 |
| 4,094,467 | A | * | 6/1978 | Meyer | 239/230 |
| 4,153,202 | A | | 5/1979 | Meyer | |
| 4,193,548 | A | | 3/1980 | Meyer | |
| 4,235,379 | A | * | 11/1980 | Beamer | 239/230 |
| 4,342,424 | A | | 8/1982 | Meyer et al. | |
| 4,720,045 | A | | 1/1988 | Meyer | |
| 6,364,217 | B1 | * | 4/2002 | Lockwood | 239/242 |

* cited by examiner

*Primary Examiner*—Kevin Shaver
*Assistant Examiner*—Anuradha Ramana
(74) *Attorney, Agent, or Firm*—Nixon & Vanderhye P.C.

(57) ABSTRACT

An actuator assembly for a rotatable sprinkler head includes a base supported for rotation on a stationary platform assembly, a hub mounted for rotation on a shaft supported in the base; a lever arm pivotally mounted at one end to the hub and extending downwardly toward a stop plate assembly on the platform assembly, the lever arm having a free end extending toward the stop plate assembly. The stop plate assembly is configured to define two or more distinct arcuate paths of travel for the lever arm, and the lever arm is adjustable to locate the free end in any of the three arcuate paths of travel.

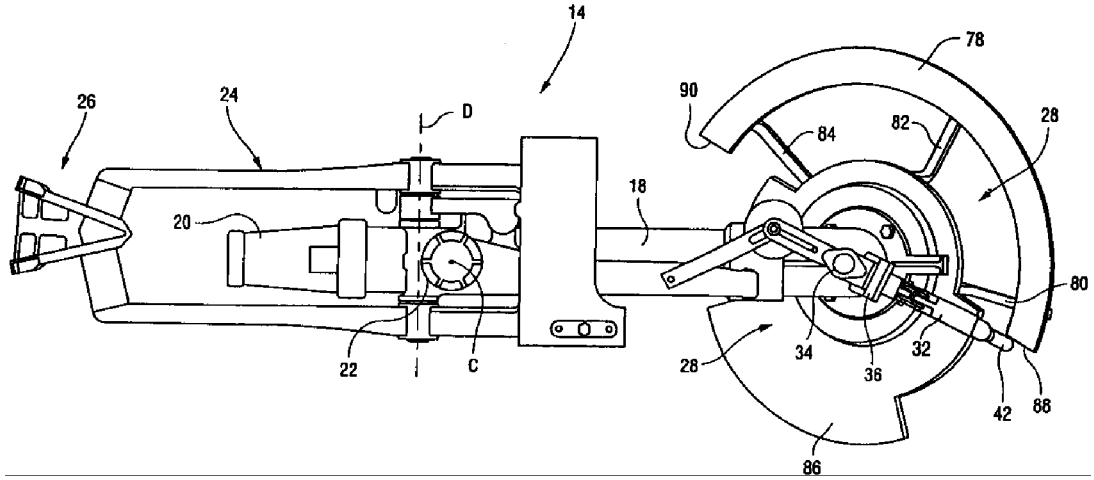

19 Claims, 10 Drawing Sheets